US006947015B2

(12) United States Patent
Akiba

(10) Patent No.: US 6,947,015 B2
(45) Date of Patent: Sep. 20, 2005

(54) PLASMA DISPLAY PANEL DRIVING METHOD, DRIVING CIRCUIT AND IMAGE DISPLAYING DEVICE

(75) Inventor: Yutaka Akiba, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 374 days.

(21) Appl. No.: 10/122,278

(22) Filed: Apr. 12, 2002

(65) Prior Publication Data

US 2002/0149548 A1 Oct. 17, 2002

(30) Foreign Application Priority Data

Apr. 13, 2001 (JP) ..... 2001-115736

(51) Int. Cl.[7] ..... G09G 3/28
(52) U.S. Cl. ..... 345/60; 345/63
(58) Field of Search ..... 345/60, 63, 66, 345/67

(56) References Cited

U.S. PATENT DOCUMENTS 5,583,527 A * 12/1996 Fujisaki et al. ..... 345/55
5,745,085 A * 4/1998 Tomio et al. ..... 345/63
6,724,356 B1 * 4/2004 Kojima et al. ..... 345/60
6,784,857 B1 * 8/2004 Nakamura ..... 345/60

* cited by examiner

*Primary Examiner*—Jimmy H. Nguyen
(74) *Attorney, Agent, or Firm*—Townsend and Townsend and Crew LLP

(57) ABSTRACT

A sustain pulse for a display discharge is controlled in either display electrode line units or line block units each comprising a plurality of these display electrode lines, on the basis of addressed cell data, whereby it is made possible to provide a plasma display panel and driving technology therefor, which enables image quality to be enhanced by suppressing brightness irregularities between electrode lines.

4 Claims, 6 Drawing Sheets

V=Vo-RoI

Vo : Vsus+Vw

Ro : Rx+Ry

PLASMA DISPLAY PANEL DRIVING METHOD, DRIVING CIRCUIT AND IMAGE DISPLAYING DEVICE

BACKGROUND OF THE INVENTION

1. Field of the Invention

The present invention is related to plasma display panel driving technology.

2. Description of the Related Art

For example, a conventional three-electrode type AC plasma display device has a panel constitution in which an electrode for address use (address electrode) and two kinds of display electrodes (X electrode, Y electrode) for display discharge, which are arranged in the same plane, and which intersect with this address electrode, are respectively arranged on separate, mutually opposing substrates, and driving for image display is performed such that, after an address pulse and a scan pulse based on an image signal have been applied to the address electrode and the display electrode of the one side (Y electrode), respectively, and addressing corresponding to this image signal has been performed, sustain pulses of a common voltage value are alternately applied to the terminals of the entire electrode lines of these two kinds of display electrodes (X electrode, Y electrode), and a display discharge is created between these two display electrodes.

SUMMARY OF THE INVENTION

In the above-mentioned prior art, due to a constitution in which a common sustain pulse voltage is applied to the above-mentioned two kinds of display electrodes (X electrode, Y electrode) via the entire display electrode lines or a line block made up of a plurality of display electrode lines, when the number of addressed cells differs between electrode lines and the number of cells which undergo display discharge (light up) differs in an electrode line, since apparent ON resistance Ron and [apparent] line resistance R1 will differ n-fold according to this number of lighted cells n, the operating point voltage and operating point current will differ between the electrode lines of individual cells according to the load line.

The larger the number of display discharge cells in an electrode line, the larger the apparent ON resistance and line resistance become.

For this reason, as shown in FIG. 3, as apparent resistance increases R0*c*, R0*b*, R0*a*, operating point current decreases Ic, Ib, Ia.

Since it becomes difficult to sustain discharge when operating point current decreases, the voltage tends to rise.

Thus, the larger the number of display discharge cells in an electrode line, the greater the decrease in brightness of the emitted light of each cell, and the average value of the emitted-light brightness of all discharge cells is also lower than an electrode line with a small number of display discharge cells.

This results in nonuniform brightness of the electrode line pitch on a screen of sub-field units, and even on a 1 field unit screen, nonuniform brightness in a plurality of sub-fields merges together, and causes the quality of a display image to decline.

With the state of this prior art in view, the problem of the present invention is to strive to improve image quality by suppressing nonuniform brightness between electrode lines in a plasma display panel.

An object of the present invention is to provide technology, which is capable of solving for this problem.

To solve for the above-mentioned problem, the present invention provides:

(1) A driving method of a plasma display panel, comprising a first step for performing an address operation by applying an address pulse to an address electrode in sub-field units, and a second step for applying a sustain pulse to a display electrode and performing a sustain operation for display based on the above-mentioned address result, wherein, in this second step, the above-mentioned sustain pulse is controlled on the basis of addressed cell data.

(2) A driving method of a plasma display panel, comprising a first step for performing an address operation in sub-field units, and a second step for performing a sustain operation for display via display electrodes based on this address result, wherein, in this second step, current at the time of the above-mentioned display electrode sustain operation is controlled either in display electrode line units, or in line block units each comprising a plurality of these display electrode lines, on the basis of addressed cell data.

(3) A driving method of a plasma display panel, comprising a first step for performing an address operation in sub-field units, and a second step for performing a sustain operation for display via display electrodes based on this address result, wherein, in this second step, a resistance connected to the above-mentioned display electrode is controlled either in display electrode line units, or in line block units each comprising a plurality of these display electrode lines, on the basis of addressed cell information.

(4) A driving method of a plasma display panel, comprising a first step for performing an address operation in sub-field units, and a second step for performing a sustain operation for display via display electrodes based on this address result, wherein, in this second step, a voltage value applied to the above-mentioned display electrode is controlled either in display electrode line units, or in line block units each comprising a plurality of these display electrode lines, on the basis of addressed cell data.

(5) The method as described in any of the above-mentioned (1) through (4), wherein, in the above-mentioned second step, control is performed such that difference in brightness of lighted cells is suppressed either between the above-mentioned display electrode lines or between line blocks each comprising a plurality of these display electrode lines.

(6) A driving circuit for a plasma display panel having an address electrode and a display electrode, comprising a first driving circuit for driving the above-mentioned address electrode with an address pulse for an address operation, a second driving circuit for driving the above-mentioned display electrode with a sustain pulse for a sustain operation, and a control circuit for controlling these first and second driving circuits, wherein, during a sustain operation, the above-mentioned control circuit and the above-mentioned second driving circuit output sustain pulses, which are controlled on the basis of the above-mentioned addressed cell data, to the above-mentioned display electrode.

(7) A driving circuit for a plasma display panel having an address electrode and a display electrode, comprising a first driving circuit for driving the above-mentioned address electrode with an address pulse for an address operation, a second driving circuit for driving the above-mentioned display electrode with a sustain pulse for a sustain operation, and a control circuit for controlling these first and second driving circuits, wherein, during a sustain operation, the above-mentioned control circuit and the above-mentioned second driving circuit apply current controlled on the basis of the above-mentioned cell data, which is addressed in either display electrode line units or line block units each comprising a plurality of these display electrode lines, to the above-mentioned display electrode.

(8) A driving circuit for a plasma display panel having an address electrode and a display electrode, comprising a first driving circuit for driving the above-mentioned address electrode with an address pulse for an address operation, a second driving circuit for driving the above-mentioned display electrode with a sustain pulse for a sustain operation, and a control circuit for controlling these first and second driving circuits, wherein, during a sustain operation, the above-mentioned control circuit and the above-mentioned second driving circuit apply a voltage controlled on the basis of the above-mentioned cell data, which is addressed in either display electrode line units or line block units each comprising a plurality of these display electrode lines, to the above-mentioned display electrode.

(9) A driving circuit for a plasma display panel having an address electrode and a display electrode, comprising a first driving circuit for driving the above-mentioned address electrode with an address pulse for an address operation, a second driving circuit for driving the above-mentioned display electrode with a sustain pulse for a sustain operation, and a control circuit for controlling these first and second driving circuits, wherein, during a sustain operation, the above-mentioned control circuit and the above-mentioned second driving circuit control a resistance connected to the above-mentioned display electrode on the basis of the above-mentioned cell data, which is addressed in either display electrode line units or line block units each comprising a plurality of these display electrode lines, relative to the above-mentioned display electrode.

(10) An image display device, comprising any of the driving circuits of the above (6) through (9), and being constituted so as to display an image on a plasma display panel.

DETAILED DESCRIPTION OF THE PREFERRED EMBODIMENTS

The embodiment of the present invention will be explained hereinbelow using the figures.

FIG. 1 through FIG. 6 are schematic diagrams of the embodiment of the present invention. This embodiment is a case of an AC plasma display, and a display emission resulting from a sustain pulse is performed for an addressed cell.

Figure 1:
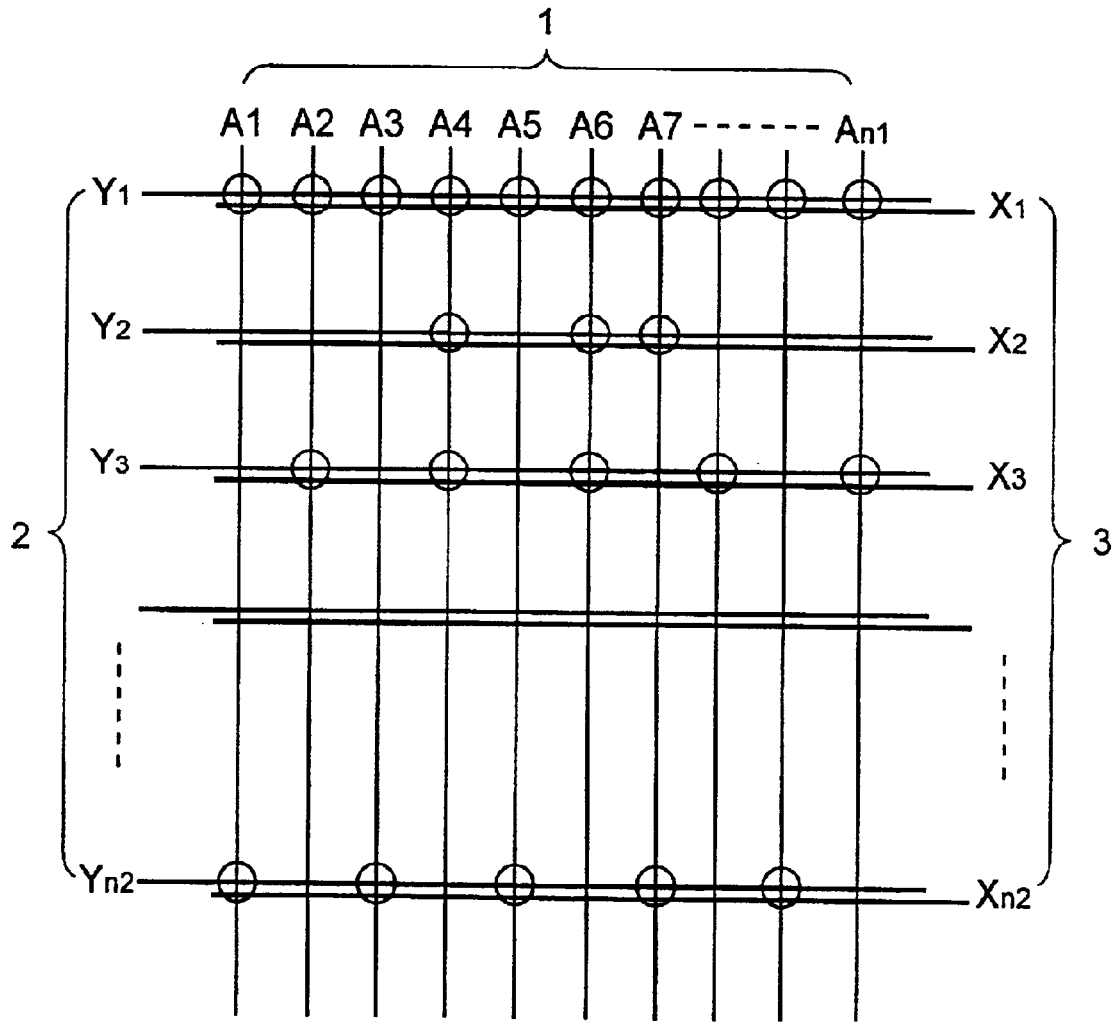
FIG. 1 is a diagram showing an example of the distribution of addressed cells in a plasma display panel.
Figure 2:
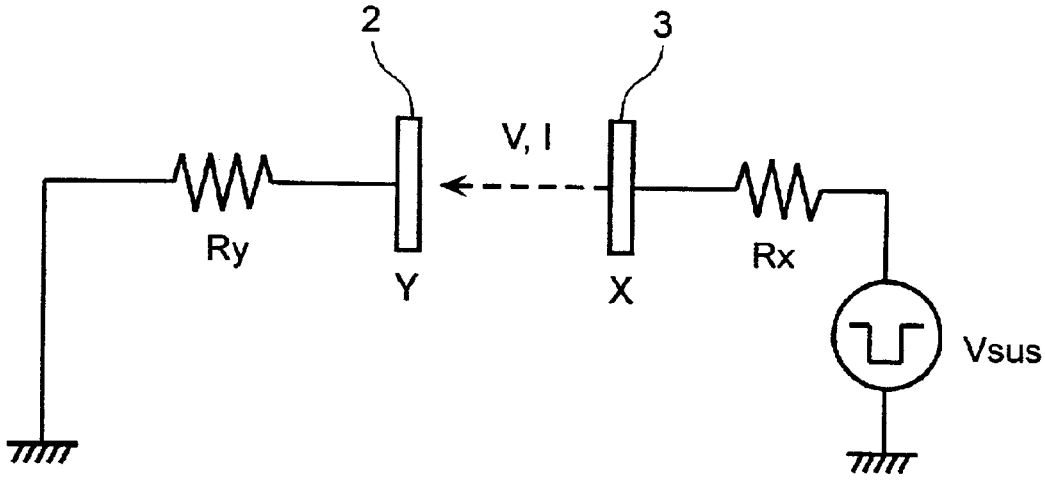
FIG. 2 is a diagram showing an example of a display electrode portion represented in a circuit diagram.
Figure 3:
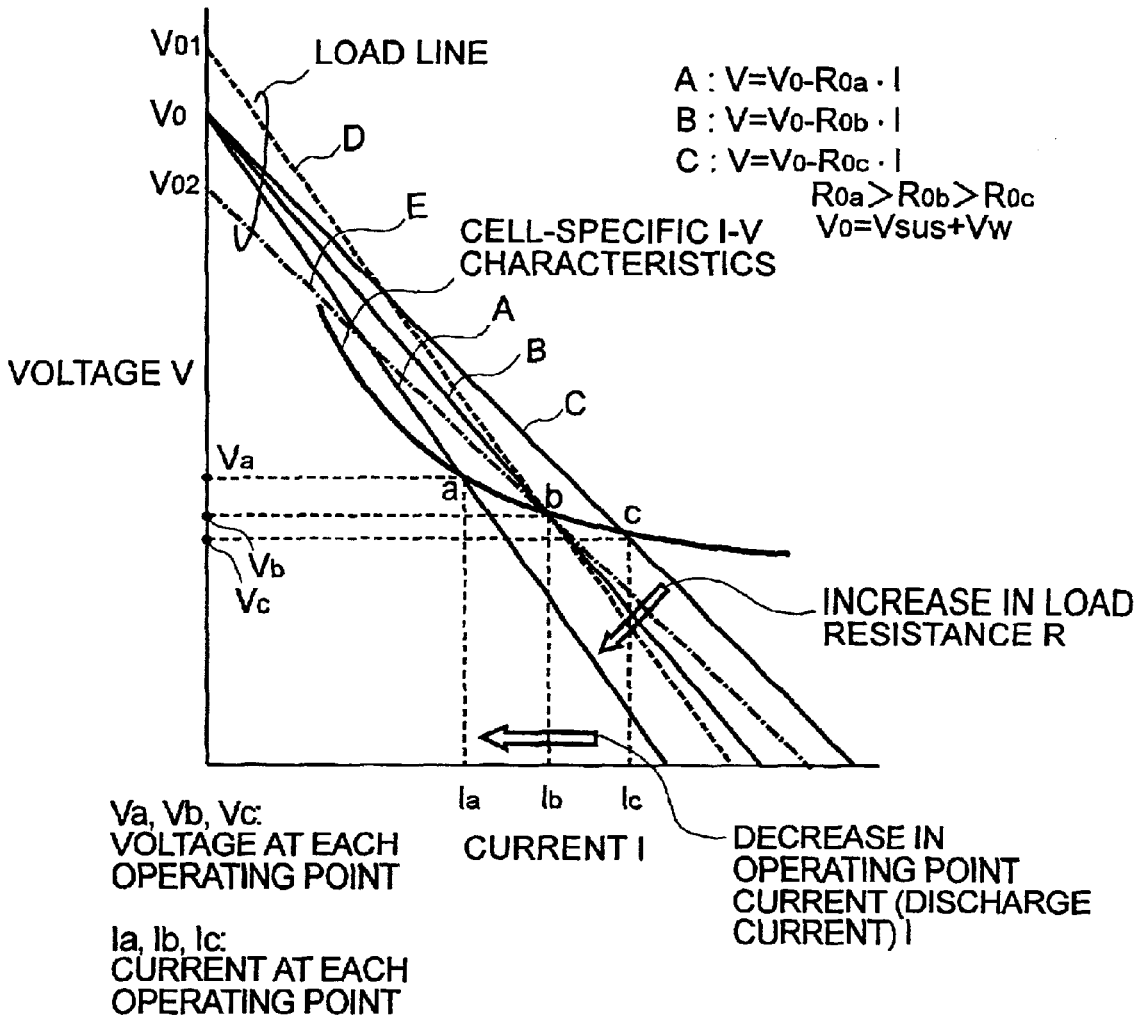
FIG. 3 is a schematic diagram of operating points in a display electrode portion.
Figure 4:
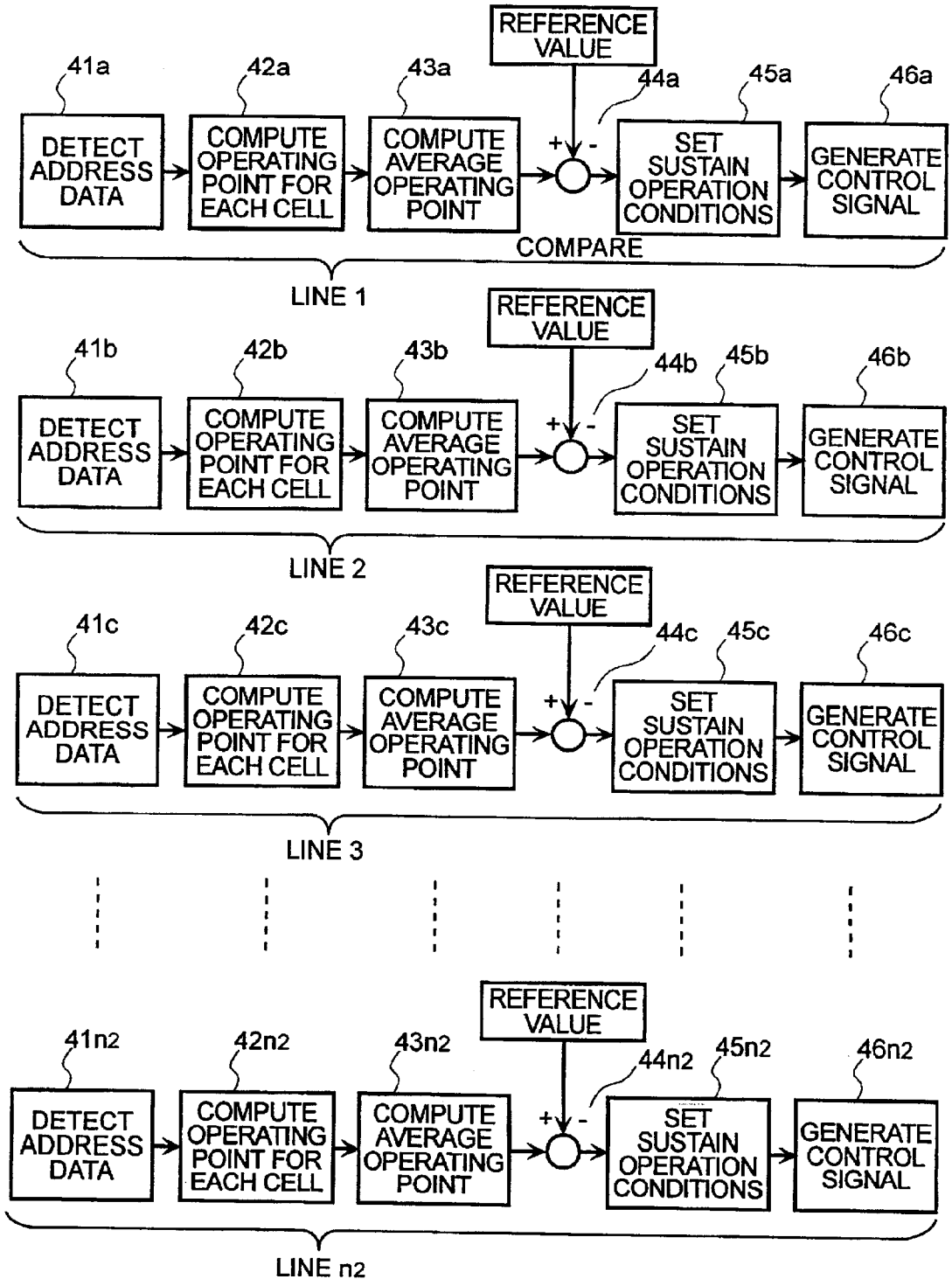
FIG. 4 is an operational flowchart for controlling the operating point from the standpoint of the characteristics of FIG. 3.
Figure 5:
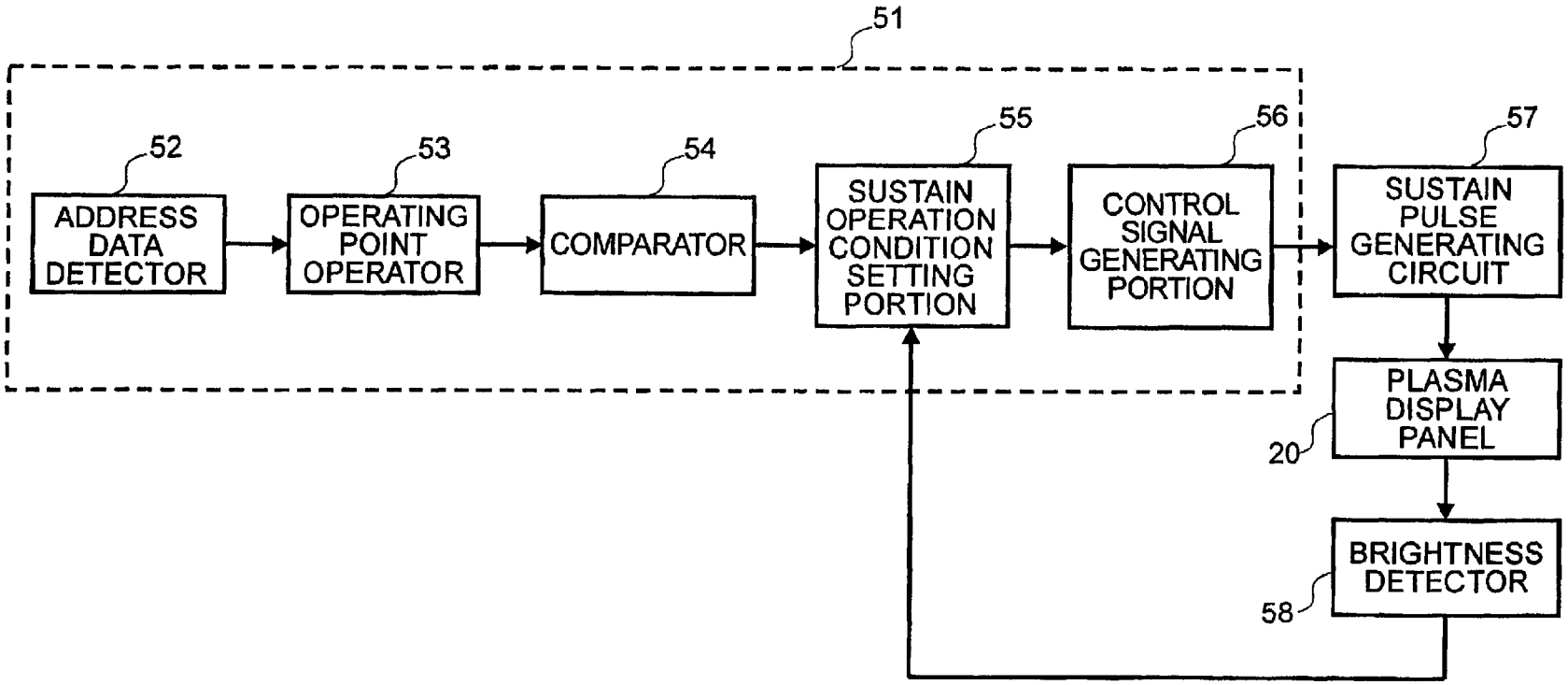
FIG. 5 is a diagram showing an example of a constitution of a control system for a display electrode.
Figure 6:
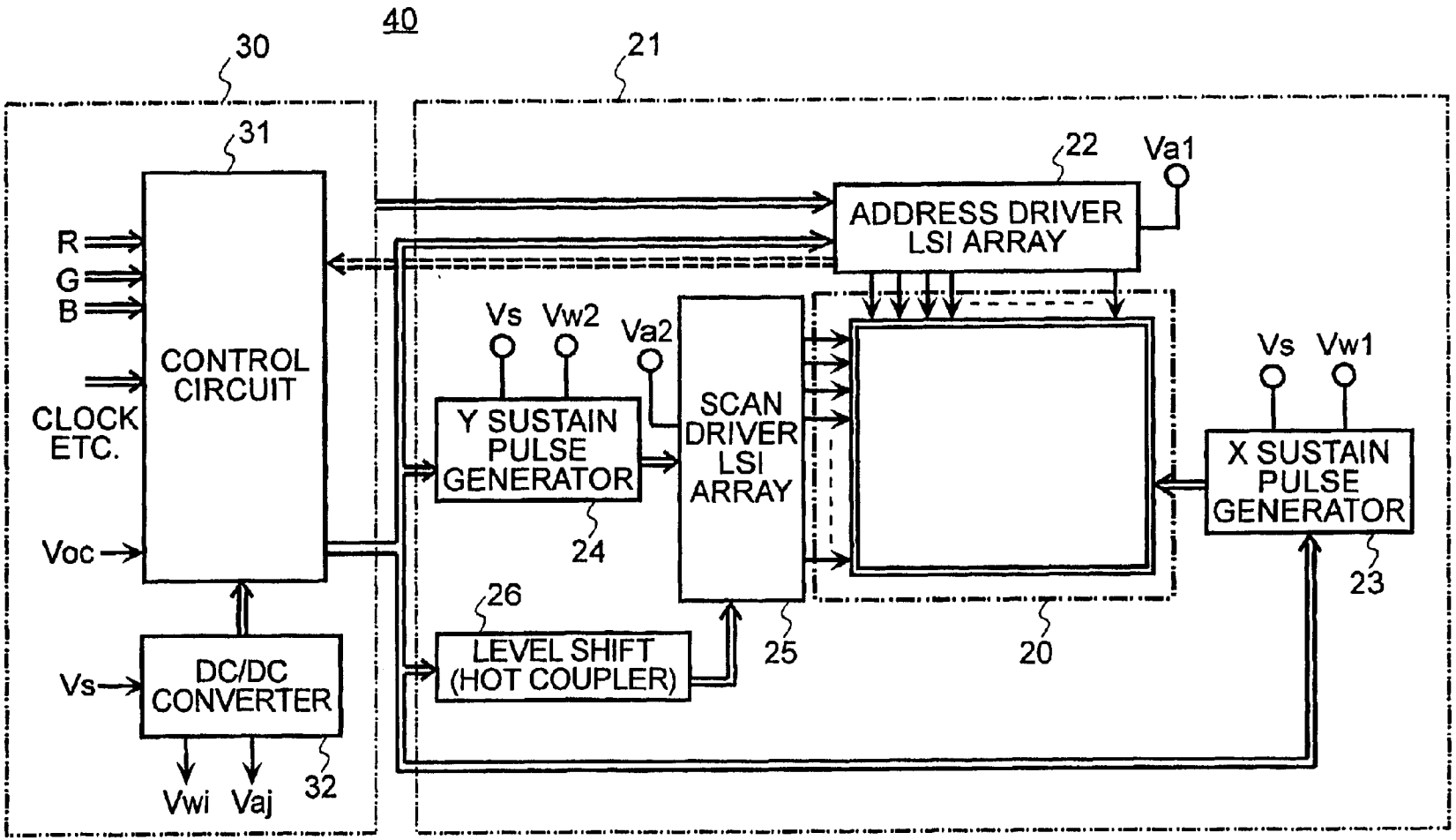
FIG. 6 is a diagram showing an example of a constitution of an image display device.

FIG. 1 is a diagram showing an example of the distribution of addressed cells on display electrode lines in a plasma display panel, FIG. 2 is a diagram showing an example of a display circuit of a display electrode portion, FIG. 3 is a schematic diagram of operating points during discharge operations (sustain operations) in a display electrode portion, FIG. 4 is an operational flowchart for controlling the operating point from the standpoint of the characteristics of FIG. 3, FIG. 5 is a diagram showing an example of a constitution of a control system for a display electrode, and FIG. 6 is a diagram showing an example of a constitution of an image display device.

In FIG. 1, 1 (A1, A2, A3, A4, . . . , An1) is an address electrode, 2 (Y1, Y2, Y3, . . . , Yn2) is a first display electrode, and 3 (X1, X2, X3, . . . , Xn2) is a second display electrode.

A cell for display use is constituted at a part, where an address electrode 1 intersects with a first and second display electrode 2, 3.

In a plasma display panel of such a constitution, an address pulse based on an image signal is inputted to an electrode selected from among the address electrodes 1 for each sub-field during an address period, a scan pulse is inputted to a first display electrode 2 at a prescribed time interval, and addressing is performed for a cell for which these two pulses coincide temporally.

In the example of FIG. 1, the cells formed at the intersection points of all the electrodes A1 through An1 of address electrode 1 on the Y1 electrode line of the first display electrode 2 are addressed, the cells formed at intersection points A4, A6 and A7 on the Y2 electrode line are addressed, the cells formed at intersection points A2, A4, A6, and . . . , An1 on the Y3 electrode line are addressed, and the cells formed at intersection points A1, A3, A5, A7 and . . . , on the Yn2 electrode line are addressed.

In an address distribution state such as this, either a sustain pulse, which is controlled in display electrode line units based on the number of these addressed cells, is applied to either any one side or both sides of the first display electrode 2 and the second display electrode 3, or the value of the resistance (ON resistance) inserted into an electrode line is controlled.

In other words, for a display electrode line with a large number of addressed cells, either a heightened-voltage sustain pulse for increasing discharge current is applied, or the value of resistance inserted into an electrode line is decreased.

For example, because of the large number of addressed cells in the Y1 electrode line and X1 electrode line, there are a large number of cells, which are display discharged by a sustain pulse application and constitute a lighted state.

Thus, apparent ON resistance and line resistance increase on the Y1 electrode line and X1 electrode line, per-cell discharge current decreases, and emitted-light brightness drops.

Furthermore, by contrast, for a display electrode line with a small number of addressed cells, either a sustain pulse, which either suppresses or reduces pulse voltage so as to either suppress or reduce discharge current, is applied, or the value of resistance (ON resistance and so forth) inserted into an electrode line is increased.

For example, there are a small number of addressed cells in the Y2 electrode line and X2 electrode line, and the number of cells lighted by the application of a sustain pulse is few.

Thus, the apparent increase of ON resistance and line resistance on the Y2 electrode line and X2 electrode line is small, the decrease in cell discharge current is also small, and emitted-light brightness is higher than the above-mentioned case of the Y1 electrode line and X1 electrode line cells.

Therefore, for the Y2 electrode line and X2 electrode line, either a sustain pulse, which either suppresses or reduces voltage so as to either suppress or reduce discharge current, is applied, or the value of resistance of the electrode line is increased, discharge current is either suppressed or reduced, and the average emitted-light brightness of all cells on these electrode lines is made uniform with the average emitted-light brightness of the cells of the Y1 electrode line and X1 electrode line, for example.

FIG. 2 is an example of a display electrode portion represented in a circuit diagram.

In FIG. 2, Ry is the sum of ON resistance and line resistance at the discharge of the Y electrode line, which is the first display electrode, Rx is the sum of ON resistance and line resistance at the discharge of the X electrode line, which is the second display electrode, V is the operating point voltage between the first and second display electrodes, I is a discharge current (operating point current) between the first and second display electrodes, Vsus is a sustain pulse voltage, Vw is a wall voltage, V0 is the sum of sustain pulse voltage Vsus and wall voltage Vw, and R0 is the sum of the above-mentioned resistance Rx and the above-mentioned resistance Ry.

As explained hereinabove, when there are a large number of addressed cells and a large number of lighted cells, the apparent resistance value of the above-mentioned resistance Rx and the above-mentioned resistance Ry increases, and as a result of this, discharge current I decreases, and the emitted-light brightness of the cells diminishes.

By contrast, when there are a small number of addressed cells and a small number of lighted cells, the increase in the apparent resistance value of the above-mentioned resistance Rx and the above-mentioned resistance Ry is small, and as a result of this, the drop in the discharge current I is suppressed, and the emitted-light brightness of the cells is high.

FIG. 3 is a schematic diagram of operating points in a discharge operation (sustain operation) in a display electrode portion.

In FIG. 3, the horizontal axis of the characteristic diagram represents the discharge current between display electrodes, the vertical axis represents the voltage between the display electrodes, the solid line is cell specific I–V characteristics, A is the load line when the sum of apparent resistance values of circuit ON resistance and line resistance is R0*a*, B is the load line when the sum of apparent resistance values of circuit ON resistance and line resistance is R0*b*, C is the load line when the sum of apparent resistance values of circuit ON resistance and line resistance is R0*c*, a is the intersection point (operating point) of the I–V characteristic and load line A, b is the intersection point (operating point) of the I–V characteristic and load line B, c is the intersection point (operating point) of the I–V characteristic and load line [C], Ia is the discharge current (operating point current) corresponding to intersection point (operating point) a, Ib is the discharge current (operating point current) corresponding to intersection point (operating point) b, and Ic is the discharge current (operating point current) corresponding to intersection point (operating point) c.

As explained hereinabove, since apparent ON resistance and [apparent] line resistance increase when there are a large number of addressed cells and a large number of lighted (discharge) cells, for example, the operating point becomes location a, and constitutes discharge current Ia (operating point voltage Va).

Further, when there are a small number of addressed cells and a small number of lighted cells, the extent of apparent increases in On resistance and line resistance is slight, and, for example, the operating point becomes location b, and constitutes discharge current Ib (operating point voltage Vb).

For an electrode line in which the number of addressed cells is even smaller, for example, the operating point becomes location c, and constitutes discharge current Ic (operating point voltage Vc).

That is, the operating point will differ like this according to either the number of addressed cells or the number of lighted cells in an electrode line unit, and nonuniform emitted-light brightness is produced between electrode lines due to differences that arise in the discharge currents.

To suppress nonuniform brightness, it is necessary to suppress fluctuations at the operating point location regardless of the number of lighted cells.

As means for suppressing the operating point, there are (1) using a constant current source, and supplying a constant current to each electrode line regardless of the number of lighted cells; (2) controlling the power supply current of each electrode line in accordance with the number of addressed cells; (3) controlling the power supply voltage based on data [regarding] the number of addressed cells; (4) connecting a resistance control circuit, which is made, for example, from an MOS (metal-oxide semiconductor), diode, or the like, to a display electrode line, and controlling the resistance value on the basis of data [regarding] the number of addressed cells; and (5) using the above-mentioned (3) and (4) together.

Here, a case in which the operating point is maintained at location b of FIG. 3 by either the voltage control of the above-mentioned (3) or the resistance control of the above-mentioned (4) will be considered by treating the above-mentioned load lines A, B, C, respectively, as characteristics when resistance, such as the control resistance in each display electrode, is connected.

For an electrode line for which there is a large number of addressed cells and a large number of lighted cells, and the operating point is at location a, when voltage control is performed so as to set the operating point to location b, the power supply voltage V0 is increased to V01, and load line A becomes load line D.

Further, when performing resistance control, the resistance value of the control resistance is decreased, and load line A becomes load line B.

Further, for an electrode line for which there is a small number of addressed cells, and a small number of lighted cells, and the operating point is at location c, when voltage control is performed so as to set the operating point to location b, the power supply voltage V0 is decreased to V02, and load line C becomes load line E.

Further, when performing resistance control, the resistance value of the control resistance is increased, and load line C becomes load line B.

FIG. 4 is an operational flowchart for controlling the operating point in the characteristics of FIG. 3.

In FIG. 4, either in advance of an address operation or subsequent to an address operation, address data of each electrode line is detected (41*a*, 41*b*, 41*c*, . . . , 41*n*2), the operating point location for each cell is computed (42*a*, 42*b*, 42*c*, . . . , 42*n*2), the average operating point location of each electrode line is computed (43*a*, 43*b*, 43*c*, . . . , 43*n*2), and thereafter, compared against a reference value (44*a*, 44*b*, 44*c*, . . . , 44*n*2), driving conditions for a sustain operation are set based on the results of this comparison (45*a*, 45*b*, 45*c*, . . . , 45*n*2), and control signals are formed on the basis thereof (46*a*, 46*b*, 46*c*, . . . , 46*n*2), and in the case of voltage control, power supply voltage can be controlled so as to achieve a predetermined fixed operating point, and a sustain pulse of a prescribed voltage value can be generated, and in the case of resistance control, the value of variable resistance constituted from resistance control circuits and the like connected to each electrode line is controlled so as to achieve a predetermined operating point.

After the results of the above-mentioned detection of address data are stored in memory, [the present invention] can be constituted such that the operating point location of each cell is determined by reading out these [results].

Address data is the number of addressed (can be either before or after a cell address operation, or at the same time as an address operation) cells.

As addressing methods, there is addressing in which a charge is applied to a cell, and removal addressing in which a charge applied to a cell is removed, and either one of these can be used in the present invention.

Furthermore, the reference value used in the above-mentioned comparison (44*a*, 44*b*, 44*c*, . . . , 44*n*2) utilizes a reference value shared in common by each electrode line.

FIG. 5 is a diagram showing an example of a constitution of a control system of a display electrode.

This example is one of a constitution of when power supply voltage is controlled on the basis of data on the number of addressed cells.

In FIG. 5, 51 is a display electrode control circuit, 52 is an address data detector for detecting data on the number of cells addressed (either before or after a cell address operation) in each electrode line, 53 is an operating point operator for computing and determining an operating point, 54 is a comparator for comparing the results of computation against an operating point reference value, 55 is a sustain driving condition setting portion for determining and setting an electrode line driving condition via a sustain pulse, 56 is a control signal generating portion for generating a control signal for controlling a sustain pulse based on established driving conditions, 57 is a sustain pulse generating circuit, 20 is a plasma display panel, and 58 is a brightness detector for detecting the brightness at discharge time (light up time) and outputting a brightness detection signal.

A brightness detection signal is inputted to the above-mentioned sustain driving condition setting portion 55, and adjusts the conditions set for sustain driving.

In the case of a resistance control method for controlling variable resistance using a resistance control circuit connected to a display electrode line, a variable resistance value is set by the above-mentioned sustain driving condition setting portion 55, and a control signal for controlling variable resistance is generated by the above-mentioned control signal generating portion 56.

FIG. 6 is an example of a constitution of an image display device comprising a plasma display panel driven by the above-mentioned control system of FIG. 5.

In FIG. 6, 40 is an image display device, 20 is a plasma display panel comprising the above-mentioned constitution shown in FIG. 2 and FIG. 3, 25 is an array of scan driver LSIs (large scale integration) (ICs (integrated circuit)) for driving and scanning a first display electrode (Y electrode) of this panel in sub-field units, 22 is an array of address driver LSIs (ICs) as a first driving circuit for generating an address pulse voltage of a timing corresponding to an image signal, driving an address electrode with this address pulse voltage, and addressing a panel display cell in sub-field units, 23 is an X sustain pulse generator [treated] as a second driving circuit for generating a sustain pulse for driving a second display electrode (X electrode), 24 is a Y sustain pulse generator [treated] as a second driving circuit for generating a sustain pulse for driving a first display electrode (Y electrode), 26 is a hot coupler for transmitting a control signal to scan driver LSI array 25, 21 is a panel-side device comprising the above-mentioned respective [components], 31 is a control circuit [treated] as a control circuit for controlling the above-mentioned scan driver LSI (IC) array 25, address driver LSI (IC) array 22, X sustain pulse generator 23, Y sustain pulse generator 24 and hot coupler 26, 32 is a DC/DC converter for generating each type of voltage required for forming a drive waveform, and 30 is a control circuit device comprising the control circuit 31 and DC/DC converter 32 thereof.

The above-mentioned display electrode control circuit 51 in FIG. 5 is formed inside the above-mentioned control circuit 31.

Address data of address driver LSI (IC) array 22 is inputted to an address data detector of control circuit 31.

According to the above-mentioned embodiment, it is possible to achieve a display device for image quality that suppresses brightness irregularities resulting from differences in the number of lighted cells among electrode lines.

The present invention comprises within its technical scope all applicable [applications], such as, for example, a display device for computer use, a flat television [set], a display device for displaying advertisements and other such information, and a presentation device for illustration purposes.

According to the present invention, it is possible to realize image quality that suppresses brightness irregularities.

What is claimed is:

1. A method of controlling a display panel having a plurality of cells and a plurality of electrode lines, each of the electrode lines applying a sustain pulse to a group of the plurality of cells, the method comprising:

detecting data on a number of cells addressed in each of the electrode lines;

computing an operation current of each cell in the group for each electrode line under an assumption that the sustain pulse has a predetermined voltage;

comparing each of the operating currents computed with a reference value to provide a result; and setting a voltage for the sustain pulse on the basis of the results, wherein the voltage of the sustain pulse is set to be higher for a particular electrode line than the predetermined voltage if the operation current computed is smaller than the reference value, wherein the voltage of the sustain pulse is set to be lower for a particular electrode line than the predetermined voltage if the operation current computed is greater than the reference value, and wherein the voltage of the sustain pulse is set to the predetermined voltage if the operation current computed is equal to the reference value; and wherein each of the preceding steps are executed successively for a sub-field period and the sustain pulse is applied to the electrode lines at the voltages set during the sub-field period.

2. A method according to claim 1 wherein the reference value is an average of the operating currents computed for the plurality of electrode lines.

3. A method according to claim 1 wherein the address data is provided to the plasma display panel for each sub-field period.

4. A method according to claim 1 wherein each of the plurality of cells of the plasma display panel includes a first display electrode and a second display electrode, both of which enable a sustain operation on the basis of address information, and an address electrode for enabling an address operation, wherein the second display electrode is coupled to one of the electrode lines, and wherein the sustain pulse applies the voltage set for the one of the electrode lines to the second display electrode.

* * * * *